US006666189B1

(12) United States Patent
Hosoya

(10) Patent No.: US 6,666,189 B1
(45) Date of Patent: Dec. 23, 2003

(54) FUEL FEED DEVICE OF ENGINE

(75) Inventor: Takayuki Hosoya, Koga (JP)

(73) Assignee: Sanoh Kogyo Kabushiki Kaisha, Ibaraki-Ken (JP)

( * ) Notice: Subject to any disclaimer, the term of this patent is extended or adjusted under 35 U.S.C. 154(b) by 62 days.

(21) Appl. No.: 10/129,905

(22) PCT Filed: Nov. 10, 2000

(86) PCT No.: PCT/JP00/07939

§ 371 (c)(1),
(2), (4) Date: May 9, 2002

(87) PCT Pub. No.: WO01/34970

PCT Pub. Date: May 17, 2001

(30) Foreign Application Priority Data

Nov. 10, 1999 (JP) ..... 11/319881

(51) Int. Cl.[7] ..... F02M 55/02
(52) U.S. Cl. ..... 123/456; 123/468; 123/467
(58) Field of Search ..... 123/456, 468, 123/469, 467

(56) References Cited

U.S. PATENT DOCUMENTS 4,526,151 A * 7/1985 Tateishi et al. ..... 123/468
5,311,850 A * 5/1994 Martin ..... 123/456
5,373,824 A * 12/1994 Peters et al. ..... 123/467
5,752,486 A * 5/1998 Nakashima et al. ..... 123/467
6,354,273 B1 * 3/2002 Imura et al. ..... 123/467
6,401,691 B1 * 6/2002 Kawano et al. ..... 123/456
6,505,608 B2 * 1/2003 Hiraku et al. ..... 123/458
6,601,564 B2 * 8/2003 Davey ..... 123/456

FOREIGN PATENT DOCUMENTS

| | | |
|---|---|---|
| JP | 9329069 | 12/1997 |
| JP | 10331743 | 12/1998 |
| JP | 112164 | 1/1999 |
| JP | 230461 | 8/2000 |
| JP | 283000 | 10/2000 |
| JP | 329031 | 11/2000 |

OTHER PUBLICATIONS

Patent Abstracts of Japan 10331743 Filed Dec. 15, 1998.
Patent Abstracts of Japan 9329069 Filed Dec. 22, 1997.
Patent Abstracts of Japan 2000–230461 Filed Aug. 22, 2000.
Patent Abstracts of Japan 2000–283000 Filed Oct. 10, 2000.
Patent Abstracts of Japan 2000–329031 Filed Nov. 11, 2000.

* cited by examiner

*Primary Examiner*—Thomas N. Moulis
(74) *Attorney, Agent, or Firm*—Ladas & Parry

(57) ABSTRACT

A fuel supply apparatus for an engine according to the present invention comprises: a plurality of injectors 13 for injecting a fuel to an intake manifold of an engine; a delivery rail 20, to which the plurality of injectors 13 are attached, for distributing the fuel to each of the injectors 13; and a fuel tube 11 for feeding the fuel, which is delivered forcedly by means of a fuel pump, to the delivery rail 20. The body portion of the delivery rail 20 has side portions having different areas, and an orifice portion wherein the end portion of the fuel tube 11 is connected to the side portion 20*a* having the largest area of the all side portions.

10 Claims, 4 Drawing Sheets

FUEL FEED DEVICE OF ENGINE

TECHNICAL FIELD OF THE INVENTION

The present invention relates generally to a fuel supply apparatus for an engine. More specifically, the invention relates to a fuel supply apparatus for an internal combustion engine, which is capable of effectively reducing the pressure pulsation of fuel while injectors for injecting a fuel open and close.

BACKGROUND ART

A typical fuel supply apparatus for an internal combustion engine for an automobile is designed to pump out a fuel to an injector via a fuel tube and to inject an appropriate amount of fuel into an intake manifold of the engine from the injector.

Conventionally, there is widely used a return type fuel supply system provided with a pressure regulator for regulating the quantity of a fuel injected from the injectors with opening and closing motion and a return tube for returning excessive fuel to a tank. In recent years, a returnless type fuel supply system requiring no return tube is put to practical use.

FIG. 6 shows a returnless type fuel supply system. In this figure, reference number 1 denotes a fuel tank. A fuel delivery rail 2 is connected to a fuel tube 4. A plurality of injectors 5 are attached to the fuel delivery rail 2.

In the returnless type fuel supply system of this type, it is known that there is a disadvantage in that a fuel pressure pulsation remarkably occurs in the fuel delivery pipe 2 and the fuel tube 4 every time the injectors 5 open and close. There is a problem in that vibrations due to the fuel pressure pulsation are transmitted as noises to the inside of a car from the underfloor of a chassis through fuel tubes. For that reason, in order to reduce the fuel pressure pulsation, there are proposed various improvements that a damper is connected to the fuel tube.

In a conventional returnless type fuel supply system, in order to reduce the fuel pressure pulsation, the fuel tube includes the damper for damping the pulsation. In addition, Japanese Patent Laid-Open No. 1999-2164 discloses a technique wherein a delivery rail having a body formed of a pressed sheet metal of 0.8 mm or more in thickness, and the rigidity and content volume of the delivery rail are set in predetermined ranges so that the pulsation resonance cycle of a fuel piping system is an idling cycle or less, thereby reducing the fuel pressure pulsation.

In the prior art disclosed in the above described Japanese Patent Laid-Open No. 1999-2164, although there is an advantage in that it is not required to use any dampers, it is required to increase the volume of the fuel piping system in order to reduce the pulsation.

However, there are some cases where it is difficult to increase the volume of the fuel piping system in a very narrow limited space for engine room in order to only reduce the fuel pressure pulsation. In addition, this is not a reasonable countermeasure against reducing the fuel pressure pulsation.

SUMMARY OF THE INVENTION

It is therefore an object of the present invention to eliminate the above described problems in the prior art and to provide a fuel supply apparatus for an engine, which is capable of effectively reducing the fuel pressure pulsation occurred by the injectors opening and closing, by using an inexpensive means and without increasing the volume of a fuel piping system.

In order to accomplish this object, there is provided a fuel supply apparatus for an engine for supplying a fuel, which is pumped out by means of a pump from a fuel tank to an engine, said fuel supply apparatus comprises a plurality of injectors for injecting the fuel to an intake manifold of the engine; a delivery rail, to which the plurality of injectors are attached, for distributing the fuel to each of the injectors; and a fuel tube for introducing the fuel, which is delivered forcedly by means of said pump, to the delivery rail, wherein a body portion of the delivery rail has side portions having different areas, and an orifice portion which is open on the largest side portion of the all side portions and to which an end portion of the fuel tube is connected.

According to the present invention, it is possible to effectively reduce the fuel pressure pulsation in the fuel tube by the injectors opening and closing, by an inexpensive tube or the like and without increasing the volume of a fuel piping system.

BEST MODE FOR CARRYING OUT THE INVENTION

Referring to the accompanying drawings, the preferred embodiment of a fuel supply apparatus for an engine according to the present invention will be described below.

First Preferred Embodiment

Figure 1:
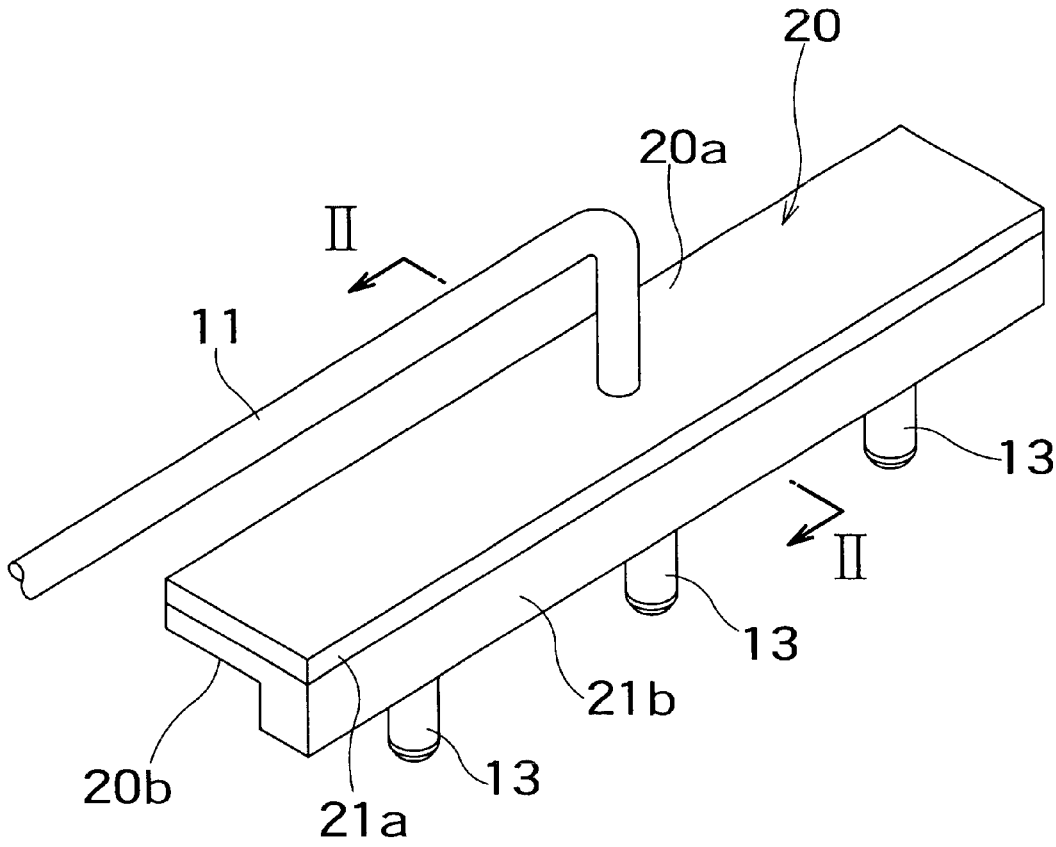
FIG. 1 is a perspective view showing the first preferred embodiment of a fuel supply apparatus for an engine according to the present invention.

FIG. 1 is a view showing the first preferred embodiment of a fuel supply apparatus for an engine according to the present invention. Reference number 20 denotes a delivery rail, and reference number 11 denotes a fuel tube. The delivery rail 20 and the fuel tube 11 constitute a returnless fuel supply system. A fuel in a fuel tank (not shown) is discharged from a pump to be pumped out forcedly to the delivery rail 20 via the fuel tube 11. The body portion of the delivery rail 20 comprises a shape tube having an L-shaped cross section. A plurality of injectors 13 are attached to the body portion of the delivery rail 20 so as to be arranged in longitudinal directions. The injectors 13 are inserted into an intake manifold of an engine (not shown).

Figure 2:
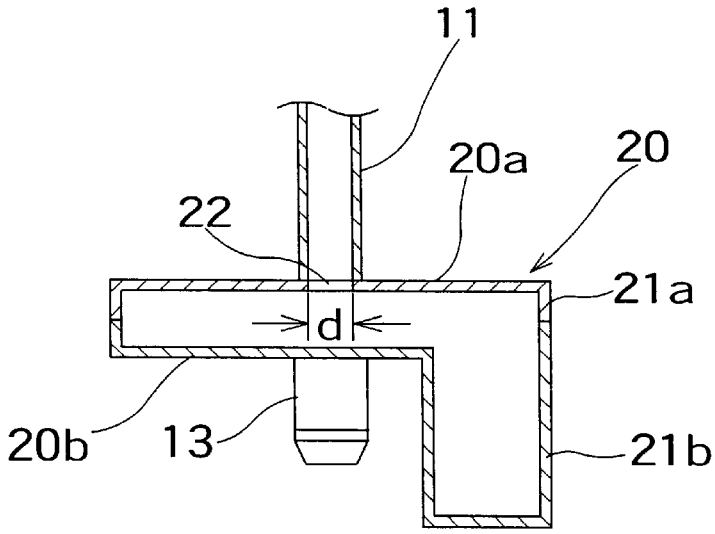
FIG. 2 is a cross-sectional view taken along line II—II of FIG. 1.

FIG. 2 is a cross-sectional view of the delivery rail 20. The body portion of the delivery pipe 20 comprises an upper case 21*a* and a lower case 21*b* which are formed of a sheet metal through a process of press working. These cases are put together by brazing or welding to form a shape tube having a cross-sectional shape formed by combining at least two rectangles, i.e., a shape tube having an L-shaped cross section in this preferred embodiment.

Since the delivery rail 20 thus forms the shape tube having the L-shaped cross section, the lengths of the respective side portions forming the cross section are different, so that the areas of six side portions are different. The end portion of the fuel tube 11 is connected to the largest upper side portion 20*a* of the six side portions. The side portion 20*a* have an orifice portion 22 opened with a diameter d. In this embodiment, the thickness of the delivery rail 20 is preferably about 0.7 mm in order to add a pulsation damping function and rigidity. The connected position of the fuel tube 11 is preferably substantially the center of the upper side portion 20*a*. Furthermore, the injectors 13 are attached to the lower side portion 20*b*.

With this construction, the advantageous function of the first preferred embodiment will be described below.

When the fuel discharged from a pump (not shown) flows through the fuel tube 11 to be fed into the delivery rail 20, the fuel is distributed into the respective injectors 13 from the delivery rail 20. The opening and closing operations of each of the injectors 13 are controlled by a control unit (not shown) in timing according to the operating conditions of the engine. That is, when the injector 13 is open, the fuel is injected from the injector 13 while it is open, and when the injector 13 is closed, the injection of the fuel is suspended. Since this fuel supply apparatus adopts the returnless system wherein any return tubes for returning the fuel to the tank are not provided, the fuel pressure pulsation is caused in the fuel tube 11 by the opening and closing repeated motions of the injectors 13.

According to the first preferred embodiment of the present invention, since the delivery pipe 20 comprises the shape tube having the L-shaped cross section, the ratio (A/a) of the area (A) of the upper side portion 20*a* to the area (a) of the orifice portion 22 can be increased without changing the volume of the delivery rail 20 itself by providing the orifice portion 22 in the largest upper side portion 20*a* to connect the fuel tube 11 to the orifice portion 22. This orifice portion 22 serves as a fuel inlet as well as an orifice for preventing the pressure pulsation caused by the injectors 13 opening and closing from transmitting to the fuel tube 11. Thus, as described above, the area ratio of the upper face portion 20*a* to the orifice portion 22, i.e., the orifice ratio (A/a), can be increased (to preferably 46 or more), so that the orifice effect is increased to more effectively suppress the propagation of pulsation toward the fuel tube of the vehicular body. In addition, since the orifice ratio can be greatly increased without increasing the volume of the delivery rail 20 itself, this is advantageous to the installation space for the delivery rail 20. Moreover, the orifice ratio can be increased without decreasing the orifice diameter d of the orifice portion 22, thus, without increasing the pressure loss.

Figure 3:
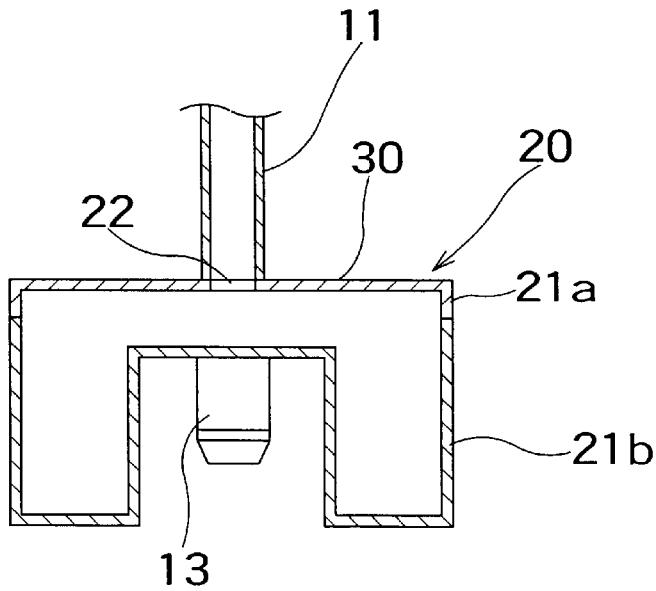
FIG. 3 is a sectional view showing a modified example of the first preferred embodiment of a fuel supply apparatus for an engine according to the present invention.

Furthermore, while the fuel tube 11 is most preferably connected to the central portion of the upper side portion 20 from the standpoint of the orifice effect, the present invention should not be limited thereto. From the standpoint of the orifice effect, there is an advantage if the fuel tube 11 is connected to the largest side, so that the cross-sectional shape of the delivery rail 20 should not be limited to the L-shaped cross section. For example, as shown in FIG. 3, the body portion of the delivery pipe rail 20 may comprise a shape tube having a C-shaped cross section, and the orifice portion 22 may be provided in the central portion of the largest side portion 30 to be connected to the end portion of the fuel tube. Thus, it is possible to obtain the same effects.

Second Preferred Embodiment

Figure 4:
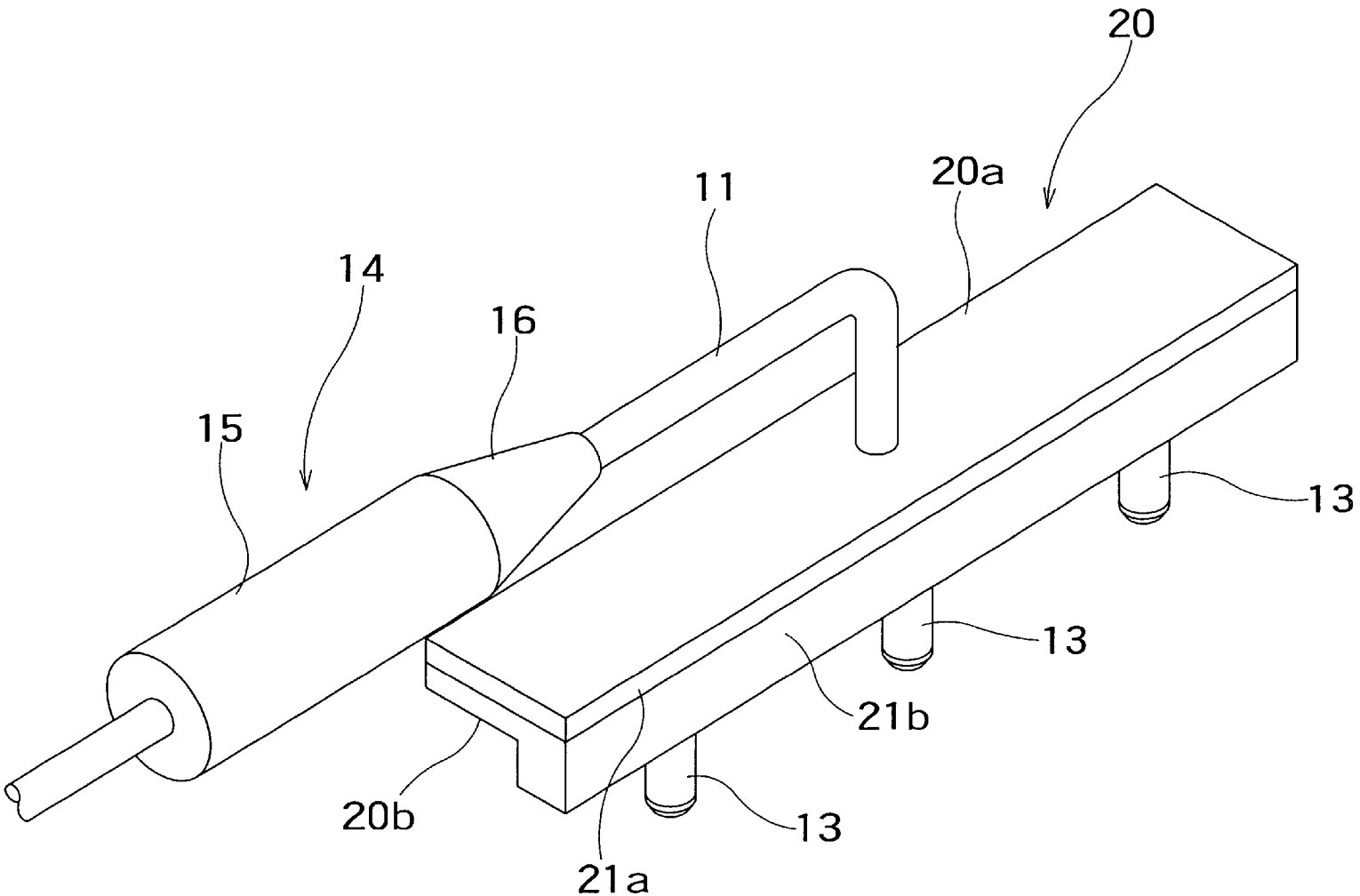
FIG. 4 is a perspective view showing the second preferred embodiment of a fuel supply apparatus for an engine according to the present invention.

FIG. 4 shows a second preferred embodiment of a fuel supply apparatus according to the present invention.

In this preferred embodiment, the body portion of the delivery rail 20 is the same as that in FIG. 1.

Figure 5:
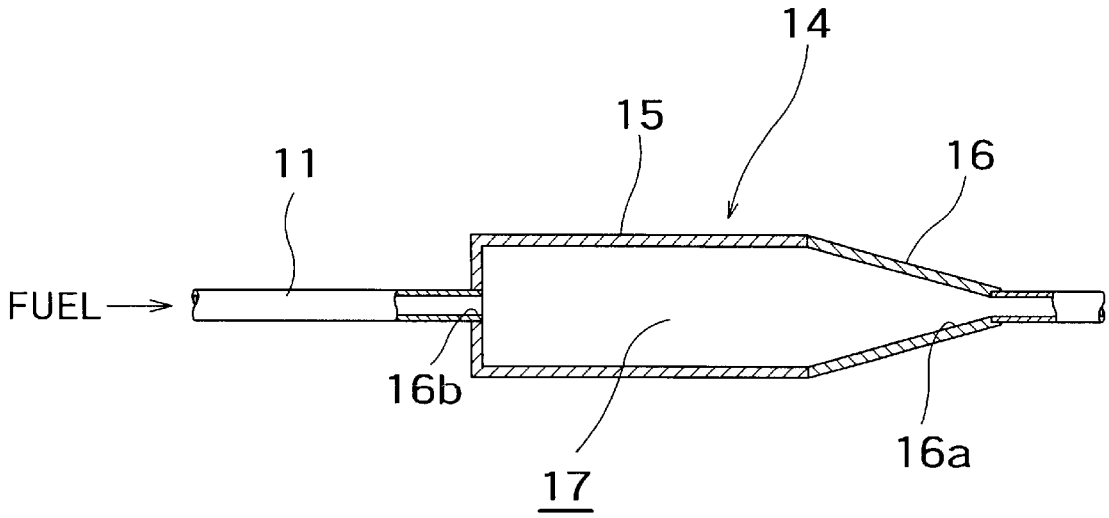
FIG. 5 is a sectional view of a muffler pipe in the preferred embodiment shown in FIG. 4.
Figure 6:
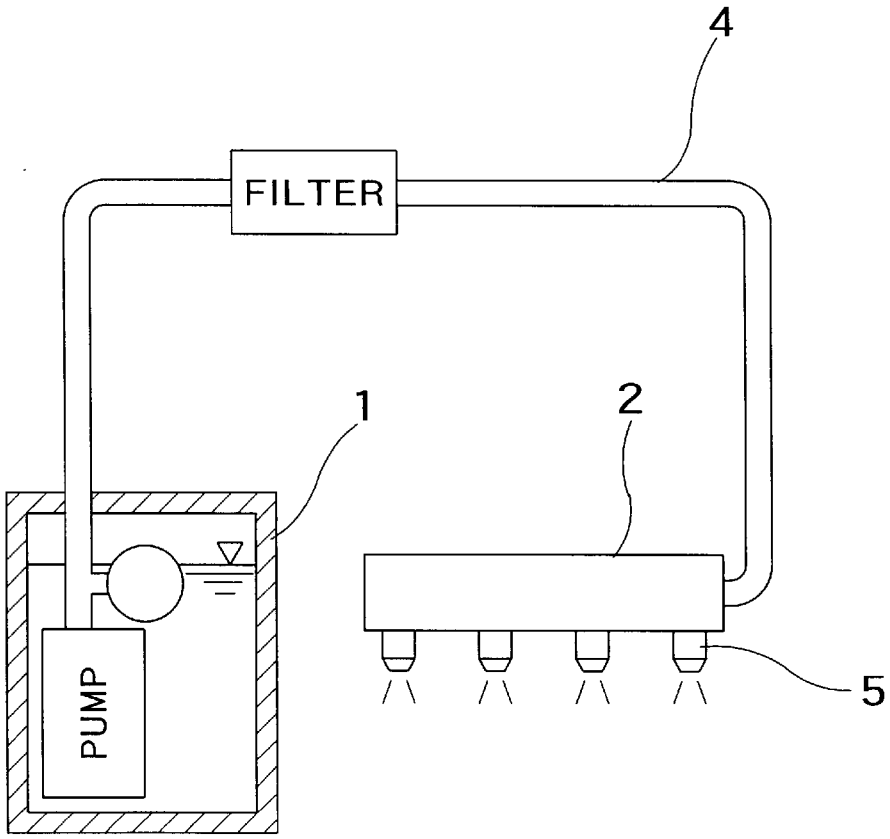
FIG. 6 is an illustration for explaining a conventional fuel returnless supply system for an engine.

A muffler tube 14 is provided in the midway along the fuel tube 11. As shown in FIG. 5, the muffler tube 14 comprises a tube body formed by brazing a cylindrical pipe 15 and a tapered pipe 16 together. And an expansion chamber 17 is formed in the muffler pipe 14.

As the cylindrical member 15, a metal thin tube, e.g., a metal tube having a thickness of 0.7 mm or less, which has a large diameter sufficient to form the expansion chamber 17 therein, is used. The tapered tube 16 forms a conical outlet passage 16*a*, the diameter of which decreases toward downstream.

The operation of the second preferred embodiment of a fuel supply apparatus according to the present invention will be described below.

Since the thickness of the cylindrical member 15 forming the expansion chamber 17 of the muffler tube 14 is small, the cylindrical member 15 is deformed to damp the fuel pressure pulsation if the pressure varies due to the pulsation. In order to maintain the rigidity of the cylindrical member 15 and ensure the deformation property for damping the pulsation, the thickness of the cylindrical member 15 is about 0.7 mm. Thus, the occurring pulsation is effectively reduced by the reactive silencer effect of such a muffler tube 14. In addition, while the fuel is fed to the engine, the pressure loss can be reduced by forming the outlet side passage 16*a* of the muffler tube 14. On the other hand, the inlet side passage 16*b* of the muffler exhibits the orifice effect, so that it is also possible to prevent the propagation of the pulsation toward the vehicular body.

In addition, by combining such a muffler tube 14 with the delivery rail 20, the propagation of pulsation to the fuel tube 11 is suppressed by the orifice effect of the delivery rail 20, and the pulsation returning to the fuel tube 11 by the reactive silencer effect of the muffler tube 14 is further damped, so that the pulsation can be more effectively reduced.

What is claimed is:

1. A fuel supply apparatus for an engine for supplying a fuel, which is pumped out by means of a pump from a fuel tank to an engine, said fuel supply apparatus comprising:

a plurality of injectors for injecting the fuel to an intake manifold of the engine;

a delivery rail, to which the plurality of injectors are attached, for distributing the fuel to each of the injectors; and a fuel tube for introducing the fuel, which is delivered forcedly by means of said pump, to the delivery rail, wherein a body portion of the delivery rail has side portions having different areas, and an orifice portion which is open on the largest side portion of the all side portions and to which an end portion of the fuel tube is connected.

2. A fuel supply apparatus according to claim 1, wherein the body portion of the delivery rail comprises a shape tube having a cross section having unequal sides.

3. A fuel supply apparatus according to claim 2, wherein the body portion of the delivery pipe comprises a shape tube having a cross-sectional shape which is formed by combining at least two rectangles.

4. A fuel supply apparatus for an engine according to claim 2, wherein the body portion of the delivery rail comprises a shape tube having an L-shaped cross section.

5. A fuel supply apparatus according to claim 2, wherein the body portion of the delivery rail comprises a shape tube having a C-shaped cross section.

6. A fuel supply apparatus according to claim 1, wherein the orifice portion is substantially formed in the central portion of the largest side portion.

7. A fuel supply apparatus according to claim 6, wherein the thickness of the side portion, in which the orifice is formed, is 0.7 mm or less.

8. A fuel supply apparatus according to claim 1, which further comprises a thin cylindrical muffler tube member which is provided in the fuel tube upstream of the delivery rail and which has an expansion chamber therein.

9. A fuel supply apparatus according to claim 8, wherein the muffler tube member is formed by connecting a thin cylindrical member to a tapered tube member, the diameter of which decreases toward downstream.

10. A fuel supply apparatus according to claim 9, wherein the thin cylindrical member of the muffler tube member is a metal tube having a thickness of 0.7 mm or less.

* * * * *